US006280056B1

(12) United States Patent
Dolan et al.

(10) Patent No.: US 6,280,056 B1
(45) Date of Patent: Aug. 28, 2001

(54) SWIVEL LAMP

(75) Inventors: Patrick S. Dolan, Portland; Nikolai Cvetkov, Beaverton, both of OR (US)

(73) Assignee: Patrick Dolan, Portland, OR (US)

( * ) Notice: Subject to any disclaimer, the term of this patent is extended or adjusted under 35 U.S.C. 154(b) by 0 days.

(21) Appl. No.: 09/531,234

(22) Filed: Mar. 21, 2000

(51) Int. Cl.[7] ..... F21V 21/14

(52) U.S. Cl. ..... 362/250; 362/287; 362/413; 362/427

(58) Field of Search ..... 362/249, 250, 362/153, 431, 239, 410, 413, 414, 287, 427

(56) References Cited

U.S. PATENT DOCUMENTS

| | | | | |
|---|---|---|---|---|
| 5,221,141 | * | 6/1993 | Swanson | 362/250 |
| 5,404,286 | * | 4/1995 | Bouitges | 362/410 |
| 5,615,946 | * | 4/1997 | Yeh | 362/250 |

* cited by examiner

*Primary Examiner*—Alan Cariaso
*Assistant Examiner*—Hargobind S. Sawhney
(74) *Attorney, Agent, or Firm*—Robert L. Harrington

(57) ABSTRACT

A lamp that is arranged for unlimited adjustment of the light fixture. A sleeve fitted to a support member is rotatable to provide rotational adjustment of an attached fixture. A bracket is pivotally mounted to the sleeve which supports the fixture. The fixture is also pivotally movable relative to the bracket. The mounting arrangement provides for unlimited adjustment of the light fixture to direct the light emanating from the fixture.

7 Claims, 2 Drawing Sheets

15
10
14
18
32
40
48
30
36
18
32
38
14
12

18
14
62
32
48
36
44
40
60
52
30
34
50
42
46
48
54
56
16
64
22
20
38
32
18
14

14
18
16
32
22
48
40
3A
3A
30
56
20
36
32
34
18
14
39
38
41
43

60
40
30
48
22
34
16
36
20

SWIVEL LAMP

FIELD OF THE INVENTION

This invention relates to a lamp having cooperative swivel connections relative to a lamp base to provide optimum maneuvering of light projection.

BACKGROUND OF THE INVENTION

Lamps are common place in households and are both decorative and functional for satisfying lighting needs. Lighting needs can be general lighting, i.e., a light source that lights a general area such as a room, or they can be for specific lighting, i.e., a light source that lights a specific area such as a display of a picture or reading material held by a person.

As an example, a living room in a home typically has arranged seating for multiple persons. Often, as between the seating places for any two people, a lamp will be provided. Typically the lamp provides general lighting that may not be satisfactory for either person to read. The lamp may in some instances be moved back and forth in an attempt to provide a more intense reading light for one or the other but such movement of the lamp is unsatisfactory.

It is accordingly an objective of the present invention to provide an adjustable lamp, i.e., one where the light can be directed at different locations and in different directions without repositioning the lamp base.

BRIEF DESCRIPTION OF THE INVENTION

In a preferred embodiment of the present invention, a lamp is provided with a cylindrical section, e.g., similar to that of a tube or pole, and a sleeve surrounds the section and can be rotated but restricted to a turn of less than 360 degrees around the section. A hollow stem is extended radially from the sleeve and an opening in the sleeve provides a passageway through the hollow stem and the sleeve. The cylindrical section has a circumferentially directed slot that extends preferably at least half way around the cylinder and up to about 300 degrees. The sleeve and stem are mounted to the cylinder and relative to the slot in a manner to provide an opening from the cylinder interior into the stem regardless of the rotative positioning of the stem within a given degree of rotation of the sleeve, e.g., 300 degrees. A bracket in the form of a stem extension is rotatably secured to the stem and a cross bore in the bracket (e.g., in the form of a secondary lateral stem extension) provides a mounting for a lamp fixture.

It will be appreciated that an electrical cord can be extended along the cylinder interior to the circumferential slot, and through the slot and into the stem, and then through the stem extensions for connection into a socket of the light fixture. It will be appreciated that the cylindrical section may be provided on a variety of lamp base configurations, an example being an upper section of a pole lamp.

The axis of the cylinder section is oriented vertically so that the stem, stem extensions and socket housing can be rotated about the vertical axis of the cylinder and in a horizontal plane, thus placing the light fixture that is extended from the L-shaped bracket at any side of the cylindrical section. The lateral stem extension rotates about the axis of the stem, e.g., through 300 degrees of rotation to thereby rotate the light fixture in a vertical plane. The fixture itself may be angularly adjustable relative to the secondary stem extension.

With the above arrangement, a single light bulb secured in the socket of the light fixture (generally referred to as a light source) can be directed as desired to enhance lighting of different seating arrangements or to emphasize various display items such as statues or paintings. A pole lamp may be provided with two or more such lighting arrangements and the top of the pole may be provided with an overhead fixed torchire lighting arrangement for general lighting of the area.

The above describes a preferred embodiment and variations thereto are contemplated. The invention will be more fully appreciated upon reference to the following detailed description having reference to the accompanying drawings.

DESCRIPTION OF THE PREFERRED EMBODIMENT

Figure 1:
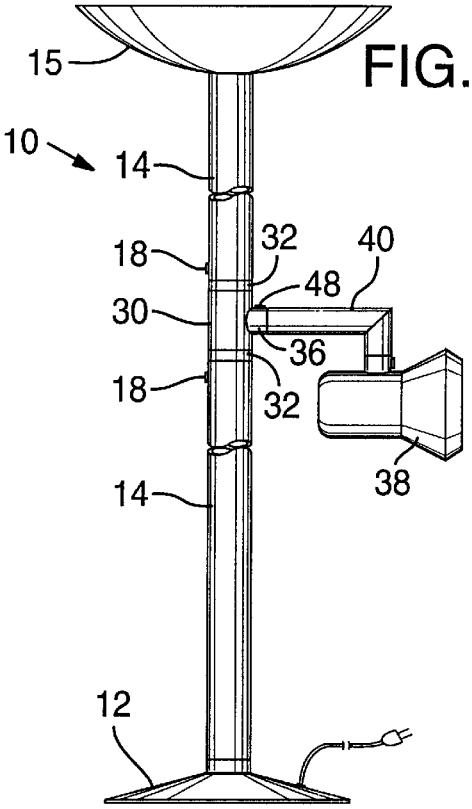
FIG. 1 is a view of an adjustable assembly for a lamp of the present invention.
Figure 2:
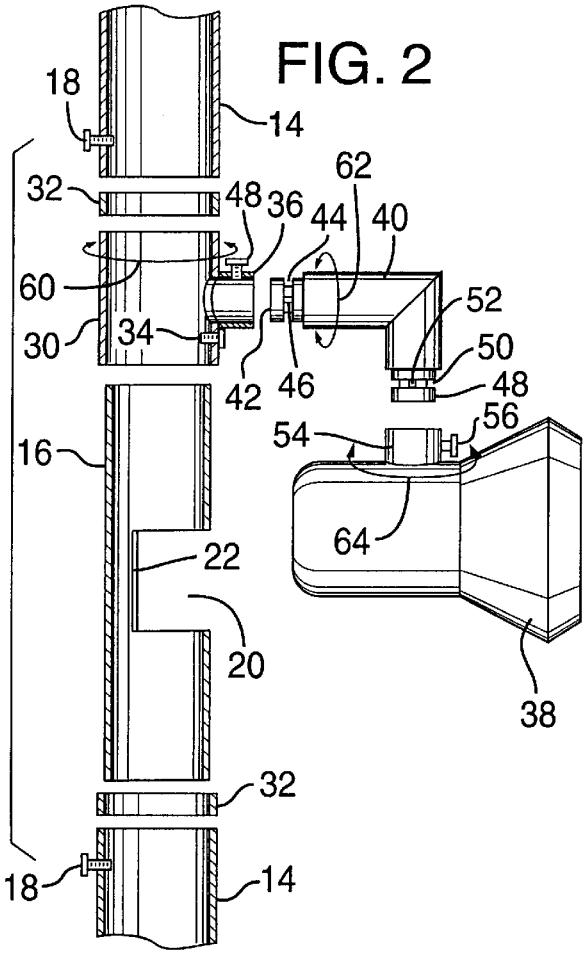
FIG. 2 is an exploded view of a portion of the lamp of FIG. 1.
Figure 3:
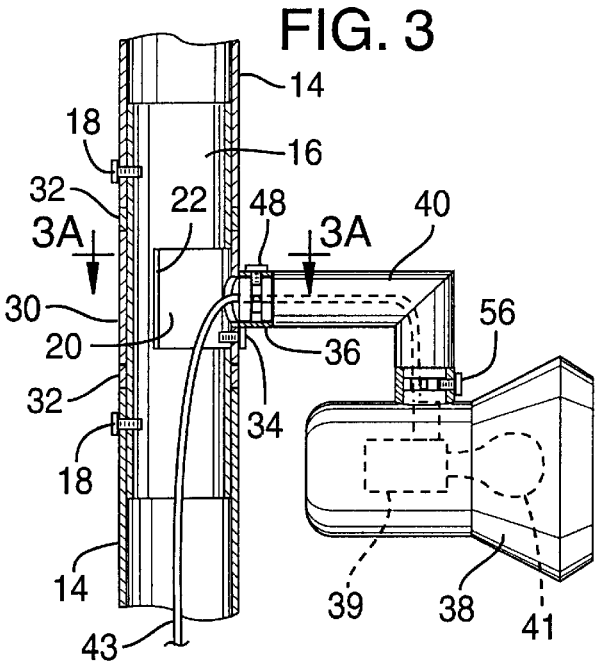
FIG. 3 is a view similar to FIG. 2 showing the lamp in assembled relation.

Refer to FIGS. 1–3 of the drawings which illustrates one embodiment of an adjustable lamp 10 of the present invention. The lamp 10 has features that permit adjusting and directing the direction of light emitted from a light fixture. The lamp 10 illustrated is a lamp that is referred to as a pole lamp. The lamp 10 has a base 12 from which a tubular section 14 is extended. A non-adjustable fixture 15 is mounted on the top of the section 14. The fixture 15 illustrated may have many varying forms, and the fixture 15 illustrated is just one example. In this embodiment the section 14 has another fixture 38 adjustably mounted between the base 12 and the fixture 15.

Referring to FIGS. 2 and 3, the section 14 is in two sections that are joined by a formed cylindrical section 16. The section 16 is insertable into the tubular sections 14 and is retained by screws 18. A portion of the side wall of the section 16 is removed which provides an opening 20 that defines a circumferential slot and connecting web 22.

A tubular sleeve 30 sized to fit over the section 16 is mounted so as to surround section 16. The sleeve 30 is rotatable on the section 16 and in the example, bearing rings 32 are provided at each end of the sleeve 30 to aid rotation of the sleeve 30 and further function as decoration.

Stop members 34 are inserted in the sleeve to limit the rotation of the sleeve on the cylindrical section 16. The stop members 34 will engage the connecting web 22 of the section 16 to limit the rotation of the sleeve 30. The sleeve 30 has a mounting stem 36 that extends from the side wall of the sleeve 30 and is arranged to receive the light fixture 38. The stem 36 is a tubular member that is arranged to receive a configured bracket 40.

The bracket 40 is an L-shaped member defining tubular stem extensions and has an end 42 that is insertable into the stem 36. A circular groove 44 is provided near end 42. The groove 44 does not extend completely around the end 42 but has a stop portion 46 that is substantially flush with the diameter of the end 42. A set screw 48 mounted in the stem 36 is provided to engage the groove 44 in the bracket 40 when the bracket 40 is installed into the stem 36. The screw 48 will retain the bracket 40 in the stem 36 and will also serve to engage the stop member 46 of the bracket 40 to limit rotation of the bracket 40 relative to the stem 36.

The end 48 of the bracket 40 is similarly arranged and has a groove 50 and a stop member 52 formed in the groove 50. A collar 54 on the Light fixture 38 is arranged to receive the end 48 of the support 40. A set screw 56 provided in the collar 54 will engage the slot 50 to retain the fixture 38 on the bracket 40 as well as engaging the stop member 52. A socket 39 with light bulb 41 is connected electrically by a wire conductor 3 that extends through the sections 14, 16 stem 36 and L-shaped bracket 40 as shown in FIG. 3.

The sleeve 30 may be swivelled or rotated around the axis of the tubular section 14 as indicated by arrow 60 in FIG. 2 with the rotation being limited by the stop member 34 engaging the web 22 of the cylindrical section 16.

Figure 3A:
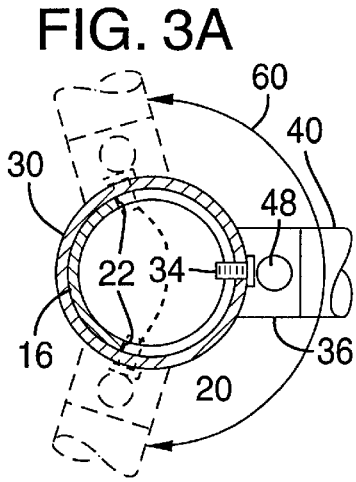
FIG. 3A illustrates the adjustability of the lamp.

The sleeve 30 in this embodiment is arranged to rotate about 300 degrees on the section 16 which provides a large range of adjustment. Similarly the bracket 40 is arranged to rotate relative to the stem 36, the rotation being limited by the screw 48 engaging the stop member 46. The fixture 38 is rotatable on the end 48 of the L-shaped bracket 40, the rotation being limited by the screw 56 engaging the stop 52. As shown in the figure, the sleeve 30 is rotatable as indicated by arrow 60, the bracket 40 is rotatable relative to the sleeve 30 as indicated by arrow 62, and the fixture 38 is rotatable on the bracket 40 as indicated by arrow 64. The direction of the light emitted from the bulb 41 of fixture 38 thus may be directed in unlimited directions. FIG. 3A illustrates the rotational capability of the sleeve 30 on the support 16 as indicated by arrow 60.

Figure 4:
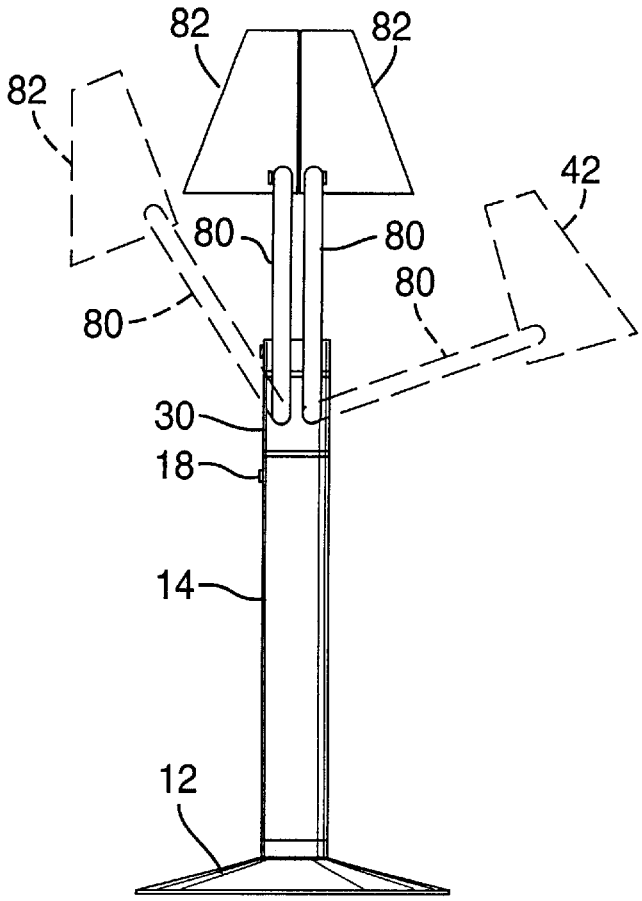
FIGS. 4 and 5 are alternate embodiments of an adjustable lamp.
Figure 5:
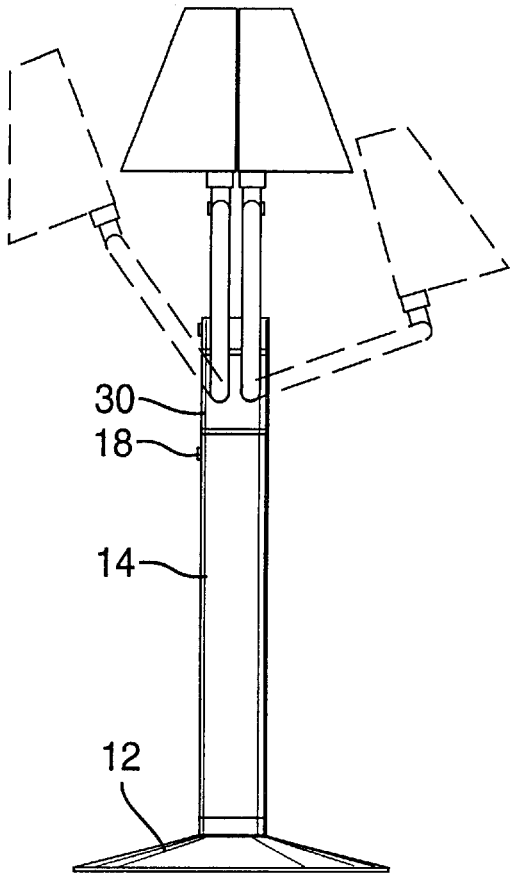

The present invention is not limited to the examples shown in FIGS. 1, 2 and 3 but is suited to other lamp configurations. For example the same concept may be applied to the lamp of FIGS. 4 and 5. In this example, the sleeve 30 is fitted with dual pivotal arms 80. The arms each have a light fixture 82 pivotally mounted on their ends. The light fixture 82 may be pivoted on the end of the arms as shown in the dashed outlines of FIGS. 4 and 5. The light from each lamp may thus be directed as desired by rotation of the sleeve 30 and/or pivoting the arms 80 as well as pivoting the light fixture on the arms. Other variations are contemplated, including but not limited to ceiling mounted lamps, wall mounted lamps and so forth.

Those skilled in the art will recognize that modifications and variations may be made without departing from the true spirit and scope of the invention. The invention is therefore not to be limited to the embodiments described and illustrated but is to be determined from the appended claims.

The invention claimed is:

1. A lamp arrangement comprising:

a cylindrical section defining a vertical axis and having a hollow interior, and a circumferential slot formed in said section and providing an opening from the interior to the exterior of the section;

a sleeve rotatably mounted to said cylindrical section surrounding said slot and a passageway projected laterally through said sleeve and defining an opening through the sleeve and into communication with said slot, and an electrically activated light source mounted to the sleeve and an electrical wire extended from said hollow interior through said passageway and connected to said light source;

said sleeve rotatable on said cylindrical section as permitted by the wire extended through the slot to provide at least partial rotation of the light source about the axis of the cylindrical section.

2. A lamp arrangement as defined in claim 1 including a hollow stem providing said passageway, a bracket having a stem extension rotatably mounted to said stem and the light source attached to said stem extension and thereby rotatable relative to said stem.

3. A lamp arrangement as defined in claim 2 wherein the bracket has a lateral secondary stem extension at the end of said stem extension and the light source is rotatably attached to said secondary stem extension.

4. A lamp arrangement as defined in claim 1 wherein said circumferential slot is at least half the circumference of the cylinder.

5. A lamp arrangement as defined in claim 1 wherein said circumferential slot is about 300 degrees around the cylinder circumference.

6. A lamp arrangement as defined in claim 3 wherein the light source is configured to project light in substantially any direction laterally of the secondary stem extension and through manipulation of the rotation of said sleeve said bracket and said light fixture to project light up, down, out or in and rotatively in between these positions at potentially any location surrounding the vertical axis of said cylindrical section.

7. A lamp arrangement as defined in claim 1 wherein stops are provided between said cylindrical section and said sleeve to limit rotation of said sleeve on said cylindrical section in either direction of rotation.

* * * * *